US009298164B2

(12) United States Patent
Courvoisier et al.

(10) Patent No.: US 9,298,164 B2
(45) Date of Patent: Mar. 29, 2016

(54) TIMEPIECE BALANCE SPRING STUD-HOLDER WITH SCREWS

(71) Applicant: ETA SA Manufacture Horlogere Suisse, Grenchen (CH)

(72) Inventors: Raphael Courvoisier, Corcelles (CH); Christian Ruefenacht, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/519,782

(22) Filed: Oct. 21, 2014

(65) Prior Publication Data

US 2015/0138931 A1 May 21, 2015

(30) Foreign Application Priority Data

Nov. 20, 2013 (EP) ..... 13193627

(51) Int. Cl.
*G04B 17/32* (2006.01)
*G04B 15/14* (2006.01)
*G04B 17/34* (2006.01)

(52) U.S. Cl.
CPC ..... *G04B 17/34* (2013.01); *G04B 15/14* (2013.01); *G04B 17/32* (2013.01); *G04B 17/325* (2013.01)

(58) Field of Classification Search
CPC ..... G04B 17/34; G04B 17/32; G04B 17/063; G04B 17/04; G04B 17/06; G04B 15/14; G04B 18/02; G04B 18/006; G04B 17/325; E05B 2015/0235; E05B 2063/0026
See application file for complete search history.

(56) References Cited

U.S. PATENT DOCUMENTS 3,046,725 A * 7/1962 Vuilleumier ..... 368/178
3,120,097 A * 2/1964 Dickerman ..... 368/174
3,154,912 A * 11/1964 Pinkas ..... 368/176
3,579,977 A * 5/1971 Meylan-Rochat ..... 368/173

(Continued)

FOREIGN PATENT DOCUMENTS

CH 332 548 A 9/1958
DE 20 2010 014 253 U1 2/2011
EP 2 290 477 A1 3/2011

OTHER PUBLICATIONS

English Translation of Damasko, DE202010014253, electronically translated May 20, 2015.*

(Continued)

*Primary Examiner* — Amy Cohen Johnson
*Assistant Examiner* — Matthew Powell
(74) *Attorney, Agent, or Firm* — Oblon, McClelland, Maier & Neustadt, L.L.P

(57) ABSTRACT

An assembly for holding a balance spring includes a stud including a surface for orienting a balance spring, and a stud-holder. The stud-holder includes a first housing for receiving the balance spring stud, a mechanism to secure the stud including a screw orthogonal to the stud, and a mechanism to secure the stud-holder to an escapement mechanism. The screw partially passes through the stud to hold the stud in an indexed position. The stud includes a second housing for the contact-free passage of the screw. The stud-holder includes on either side of the first housing an internal thread cooperating with the screw and a third bore for the passage of a head of the screw cooperating in abutment with the orientation surface.

5 Claims, 1 Drawing Sheet

(56) References Cited

U.S. PATENT DOCUMENTS

| | | | | |
|---|---|---|---|---|
| 3,630,017 | A * | 12/1971 | Marti | 368/176 |
| 3,673,376 | A * | 6/1972 | Kullmann | 219/121.64 |
| 7,059,764 | B2 * | 6/2006 | Hintze et al. | 368/127 |
| 2010/0188941 | A1 * | 7/2010 | Fujieda | 368/324 |
| 2011/0051565 | A1 | 3/2011 | Schmiedchen | |

OTHER PUBLICATIONS

European Search Report issued Jun. 11, 2014, in European Application No. 13193627 filed Nov. 20, 2013 (with English Translation).

* cited by examiner

TIMEPIECE BALANCE SPRING STUD-HOLDER WITH SCREWS

This application claims priority from European Patent Application No. 13193627.0 filed 20 Nov. 2013, the entire disclosure of which is incorporated herein by reference.

FIELD OF THE INVENTION

The invention concerns an assembly for holding or supporting a timepiece balance spring including a balance spring stud and a stud-holder, wherein said stud-holder includes:

a first housing for receiving said balance spring stud;

means of securing said balance spring stud including at least one screw whose axis is orthogonal to that of said stud;

and means of securing said stud-holder to an escapement mechanism, said balance spring stud including at least one orientation surface defining a direction of holding or supporting a said balance spring, wherein said at least one screw at least partially passes through said balance spring stud to hold the stud in an indexed locking position.

The invention also concerns a timepiece escapement mechanism including at least one such assembly.

The invention also concerns a timepiece movement including at least one such escape mechanism.

The invention also concerns a timepiece comprising at least one such movement.

The invention concerns the field of timepiece escapement mechanisms including a balance spring.

BACKGROUND OF THE INVENTION

In numerous mass-produced calibres, the balance spring stud, forming the external point of attachment of the balance spring, is clipped to a stud-holder, which is a flat, stamped part.

In high end productions, the balance spring stud is screwed into a stud-holder which is a machined component. The retaining screw then works between the foot and threads of the screw. The head is never locked, which causes frequent breakage, as a result of the torsion stresses experienced when the foot is locked onto the balance spring stud and when the operator continues to turn the screw.

DE Utility Model No 202010024253 in the name of DAMASKO describes a balance spring stud with radial adjustment relative to the balance cock. The axially threaded stud cooperates with a cylindrical screw, whose head moves in a milled oblong groove.

EP Patent Application No 2290477A1 in the name of GLASHÜTTE UHRENBETRIEB describes a stud-holder which includes an internal thread for securing the stud retaining screw, which cooperates with a recess in said stud, over one part of the thickness of the stud.

SUMMARY OF THE INVENTION

The invention proposes to create a modified balance spring stud, so as to correct the use of the screw, so that the screw can operate normally, by elastic deformation between its head and threads. Thus, the issue is to reduce the risk of breakage while maintaining the high-end structure of a stud holder with screws. To this end, the invention concerns an assembly for holding or supporting a timepiece balance spring including a balance spring stud and a stud-holder, wherein the stud-holder includes:

a first housing for receiving said balance spring stud;

means of securing said balance spring stud including at least one screw whose axis is orthogonal to that of said stud;

and means of securing said stud-holder to an escapement mechanism, said balance spring stud including at least one orientation surface defining a direction of holding or supporting a said balance spring, wherein said at least one screw at least partially passes through said balance spring stud to hold the stud in an indexed locking position, characterized in that said stud includes at least a second housing for the contact-free passage of said at least one screw, and said stud-holder includes:

on a first side of said first housing for said balance spring stud, an internal thread cooperating with said at least one screw;

on a second side of said first housing for said balance spring stud, a third bore for the passage of a screw head comprised in said at least one screw, said screw head cooperating with said orientation surface of said balance spring stud formed by a flat portion.

The invention also concerns a timepiece escapement mechanism including at least one such assembly.

The invention also concerns a timepiece movement including at least one such escape mechanism.

The invention also concerns a timepiece including at least one movement of this type, characterized in that the timepiece is a watch.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 2:
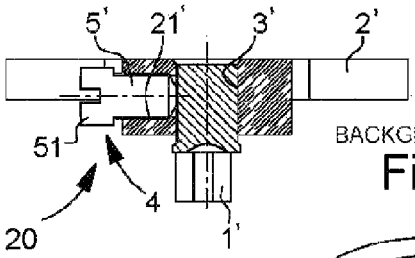
BACKGROUND ART Fig. 2
FIG. 2 is a cross-section, in a plane through the axis of the screw and the axis of the stud, of the assembly of FIG. 1.

The invention concerns an assembly 20 for holding or supporting a timepiece balance spring 21 including a balance spring stud 1 and a stud-holder 2.

This stud-holder 2 includes:

a first housing 3 for receiving balance spring stud 1;

means 4 for securing stud 1 including at least one screw 5;

and means 6 of securing stud-holder 2 to an escapement mechanism 30, Balance spring stud 1 includes at least one orientation surface 7 defining a direction of holding or supporting a balance spring 21 of this type.

Figure 1:
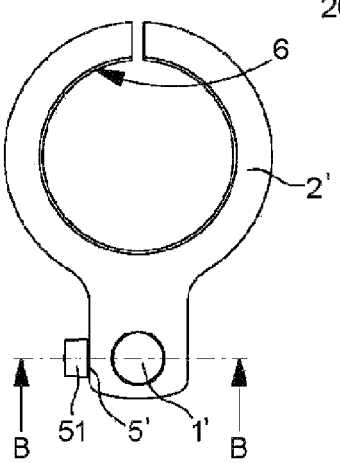
BACKGROUND ART Fig. 1
FIG. 1 shows a schematic, plan view of an assembly for holding a balance spring according to the prior art, including a stud-holder, a stud housed in a bore of the stud-holder, and a screw engaged in an internal thread of the stud-holder and bearing on the stud.
Figure 3:
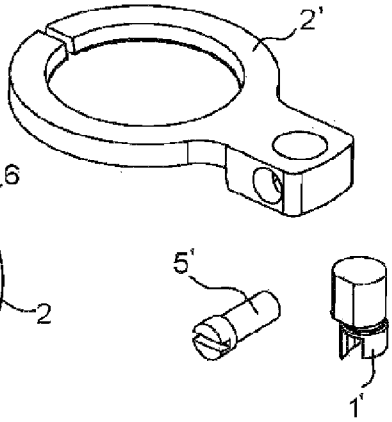
BACKGROUND ART Fig. 3
FIG. 3 shows a schematic, perspective, exploded view of the assembly of FIG. 1.

FIG. 1 illustrates the prior art, with a balance spring stud 1' housed in a bore 3' of stud-holder 2' and a screw 5', whose axis is orthogonal to that of stud l' and which is engaged in an internal thread 21' of stud-holder 2' and bears on a lateral face of stud 1'.

This at least one screw 5' at least partially passes through balance spring stud 1' to hold the stud in an indexed locking position.

Stud-holder 2' may include a recess to allow for adjustment of the flatness of the balance spring by unscrewing the screw. Indeed, watchmakers take care always to position the balance spring so that it is as flat as possible. If the point of attachment on the stud is, for example, lower than the point of attachment on the balance staff, the balance spring will tend to adopt an umbrella shape. To correct this phenomenon, the watchmaker unscrews the stud screw and raises the stud until the two points of attachment are at the same height, and the balance spring is thus made flat again. However, this adjustment is only possible where the stud can be moved inside the stud-holder.

In the embodiment of the invention, the through hole passing through the stud prevents movement. An adjustment is not possible in a version with a cylindrical hole; in a variant an oblong allows for this adjustment in height.

Figure 4:
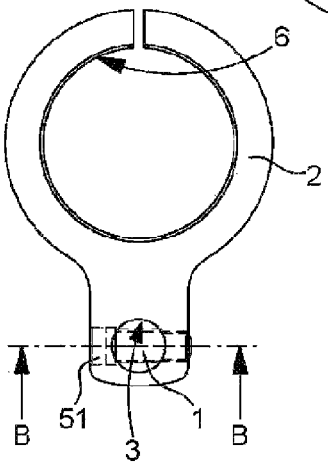
FIG. 4 shows, in a similar manner to FIG. 1, a first embodiment of the invention, wherein the screw passes through a bore of the balance spring stud and cooperates, on the opposite side to the screw head, with an internal thread of the stud-holder.
Figure 5:
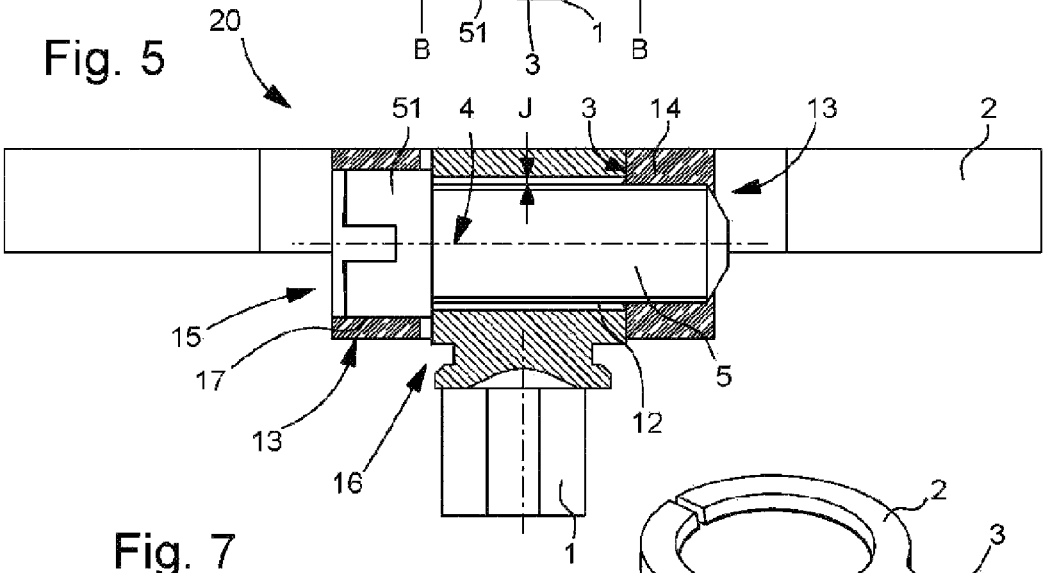
FIG. 5 shows, in a similar manner to FIG. 2, the assembly of FIG. 4.
Figure 7:
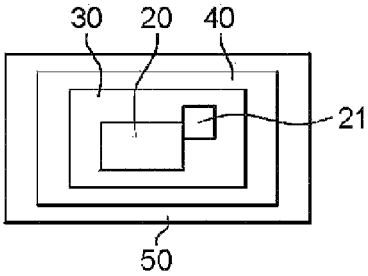
FIG. 7 is a block diagram showing a timepiece comprising a movement which includes an escapement mechanism including a balance spring held by an assembly according to the invention.
Figure 6:
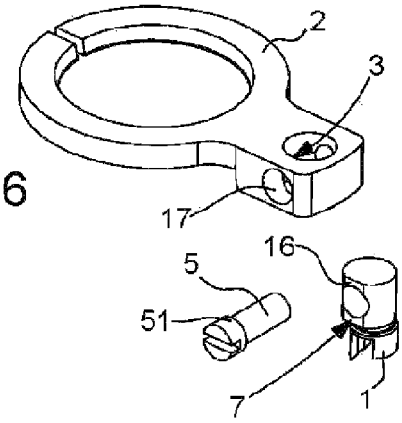
FIG. 6 shows, in a similar manner to FIG. 3, the assembly of FIG. 4.

As seen in FIGS. 4 to 6, balance spring stud 1 includes at least a second housing 12 for the contact-free passage of said at least one screw 5 and said stud-holder 1 includes:

on a first side 13 of said first housing 3 for said balance spring stud 1, an internal thread 14 cooperating with said at least one screw 5;

on a second side 15 of said first housing 3 for said balance spring stud 1, a third bore 17 for the passage of a screw head 51 comprised in said at least one screw 5, said screw head 51 cooperating with said orientation surface 7 of said stud 1 formed by a flat portion 16.

Balance spring stud 1 is pushed against stud-holder 2 by screw 5 and the orientation is given by screw head 51.

In a first variant, to allow for a height adjustment of balance spring stud 1, this at least one second housing 12 is oblong in a direction perpendicular to that of said at least one screw 5, for the height adjustment of said balance spring stud 1.

In a second variant, to allow for a height adjustment of stud 1 as explained above, this at least one second housing 12 is of greater size than the outer diameter of the external thread of said at least one screw 5, particularly in the form of an oblong, with an adjustment play J for the height adjustment of balance spring stud 1. The diameter of screw head 51 is sized to remain in abutment on the periphery of second housing 12 in every adjustment position of balance spring stud 1.

Preferably, there is only one screw 5, and only one internal thread 12 of stud 1.

The invention also concerns a timepiece escapement mechanism 30 including at least one such assembly 20.

The invention also concerns a timepiece movement 40 including at least one escapement mechanism 30 of this type.

The invention also concerns a timepiece 50 including at least one such movement 40. Specifically, this timepiece 50 is a watch.

The invention provides various advantages:

the screw does not work in torsion, but in traction, and the risk of breaking the screw is reduced;

a stable adjustment is ensured and allows for integration into a high-end movement;

a height adjustment is possible;

the stud-holder assembly according to the invention is interchangeable with a prior art stud-holder, which makes it possible to improve existing movements.

What is claimed is:

1. An assembly to hold or support a timepiece balance spring including a balance spring stud and a stud-holder, the stud-holder comprising:

a first housing to receive said balance spring stud;

a mechanism to secure said balance spring stud including at least one screw whose axis is orthogonal to an axis of said stud; and a mechanism to secure said stud-holder to an escapement mechanism, said balance spring stud including at least one orientation surface defining a direction to hold or support said balance spring, wherein said balance spring stud includes at least a second housing which is a through hole for contact-free passage of said at least one screw, and said at least one screw passes through said balance spring stud completely to hold said balance spring stud in an indexed locking position, wherein said stud-holder includes:

on a first side of said first housing for said stud, an internal thread cooperating with said at least one screw; and on a second side of said first housing for said stud, a third bore for passage of a screw head comprised in said at least one screw, said screw head cooperating with said orientation surface of said stud formed by a flat portion, and wherein said at least one second housing is oblong in a direction perpendicular to a direction of said at least one screw, for height adjustment of said stud.

2. The assembly according to claim 1, wherein said at least one second housing is of larger size than an outer diameter of an external thread of said at least one screw, with an adjustment play for the height adjustment of said stud, the diameter of said screw head being sized to remain in abutment on periphery of said second housing in every adjustment position of said stud.

3. A timepiece escapement mechanism including at least one said assembly according to claim 1.

4. A timepiece movement including at least one said escapement mechanism according to claim 3.

5. A timepiece including at least one said movement according to claim 4, wherein the timepiece is a watch.

* * * * *